US008478178B2

(12) United States Patent
Condello et al.

(10) Patent No.: US 8,478,178 B2
(45) Date of Patent: Jul. 2, 2013

(54) FIXING DEVICES FOR FIXING MARKING MATERIAL TO A WEB WITH CONTACT PRE-HEATING OF WEB AND MARKING MATERIAL AND METHODS OF FIXING MARKING MATERIAL TO A WEB

(75) Inventors: Anthony S. Condello, Webster, NY (US); Dale R. Mashtare, Bloomfield, NY (US)

(73) Assignee: Xerox Corporation, Norwalk, CT (US)

( * ) Notice: Subject to any disclaimer, the term of this patent is extended or adjusted under 35 U.S.C. 154(b) by 259 days.

(21) Appl. No.: 12/855,036

(22) Filed: Aug. 12, 2010

(65) Prior Publication Data

US 2012/0039646 A1 Feb. 16, 2012

(51) Int. Cl.
*G03G 15/20* (2006.01)

(52) U.S. Cl.
USPC ..... 399/328; 399/122; 399/320; 399/329; 399/330

(58) Field of Classification Search
USPC ..... 399/122, 320, 328–330
See application file for complete search history.

(56) References Cited

U.S. PATENT DOCUMENTS

| | | | | |
|---|---|---|---|---|
| 6,873,818 | B2 * | 3/2005 | Regimbal | 399/329 |
| 7,322,689 | B2 | 1/2008 | Kohne et al. | |
| 7,402,371 | B2 | 7/2008 | Sacripante et al. | |
| 7,407,278 | B2 | 8/2008 | Kohne et al. | |
| 7,494,757 | B2 | 2/2009 | Sacripante et al. | |
| 7,547,499 | B2 | 6/2009 | Veregin et al. | |
| 7,682,014 | B2 | 3/2010 | Snyder et al. | |
| 2005/0129432 | A1 * | 6/2005 | Sato et al. | 399/329 |
| 2005/0136261 | A1 * | 6/2005 | Tani | 428/411.1 |
| 2009/0009573 | A1 | 1/2009 | Larson et al. | |
| 2009/0021550 | A1 | 1/2009 | Leighton et al. | |
| 2009/0102906 | A1 | 4/2009 | Phillips et al. | |
| 2009/0110453 | A1 * | 4/2009 | Kuntz et al. | 399/333 |
| 2010/0045720 | A1 | 2/2010 | Williams et al. | |
| 2010/0176117 | A1 * | 7/2010 | Kladias et al. | 219/216 |

FOREIGN PATENT DOCUMENTS

JP 59010977 A * 1/1984

OTHER PUBLICATIONS

JP 59010977 A, English Abstract, Shinohara et al., Jan. 1984.*
James Williams et al.; Temperature Leveling Roller and Pressure Nip Assembly; U.S. Appl. No. 12/617,255, filed Nov. 12, 2009.

* cited by examiner

*Primary Examiner* — Ryan Walsh
(74) *Attorney, Agent, or Firm* — Ronald E. Prass, Jr.; Prass LLP

(57) ABSTRACT

Fixing devices for fixing marking material to a web, printing apparatuses and methods of fixing marking material to a web are provided. An exemplary embodiment of the fixing devices includes a first roll including a heated outer surface; a second roll forming a fixing nip with the outer surface of the first roll at which a continuous web on which marking material is disposed is received; a third roll positioned to contact the web prior to entering the fixing nip; and an adjustment mechanism connected to the third roll. The adjustment mechanism is operable to move the third roll to vary a wrap length of the web contacting the outer surface of the first roll upstream from the fixing nip to control pre-heating of the web and marking material by contact with the outer surface prior to entering the fixing nip. The first roll and second roll are operable to apply heat and pressure to the pre-heated web and marking material at the fixing nip to fix the marking material to the web.

22 Claims, 3 Drawing Sheets

FIXING DEVICES FOR FIXING MARKING MATERIAL TO A WEB WITH CONTACT PRE-HEATING OF WEB AND MARKING MATERIAL AND METHODS OF FIXING MARKING MATERIAL TO A WEB

RELATED APPLICATIONS

This application is related to the applications entitled "MULTI-STAGE FIXING SYSTEMS, PRINTING APPARATUSES AND METHODS OF FIXING MARKING MATERIAL TO SUBSTRATES" Ser. No. 12/855,011; "FIXING DEVICES INCLUDING LOW-VISCOSITY RELEASE AGENT APPLICATOR SYSTEM AND METHODS OF FIXING MARKING MATERIAL TO SUBSTRATES" Ser. No. 12/855,054; "FIXING DEVICES INCLUDING CONTACT PRE-HEATER AND METHODS OF FIXING MARKING MATERIAL TO SUBSTRATES" Ser. No. 12/855,066; "FIXING SYSTEMS INCLUDING IMAGE CONDITIONER AND IMAGE PRE-HEATER AND METHODS OF FIXING MARKING MATERIAL TO SUBSTRATES" Ser. No. 12/855,078); "FIXING DEVICES INCLUDING EXTENDED-LIFE COMPONENTS AND METHODS OF FIXING MARKING MATERIAL TO SUBSTRATES" Ser. No. 12/855,506); and "LOW ADHESION COATINGS FOR IMAGE FIXING" Ser. No. 12/855,140), each of which is filed on the same date as the present application, commonly assigned to the assignee of the present application, and incorporated herein by reference in its entirety.

BACKGROUND

In printing processes, marking material is applied onto substrates to form images. The images can be subjected to a combination of heating and applied pressure to fix the marking material to the substrates.

It would be desirable to provide fixing devices, printing apparatuses and methods for fixing marking material to a web that can provide adjustable contact pre-heating of the marking material for different web types.

SUMMARY

Fixing devices for fixing marking material to a web, printing apparatuses and methods of fixing marking material to a web are provided. An exemplary embodiment of the fixing devices comprises a first roll including a heated outer surface; a second roll forming a fixing nip with the outer surface of the first roll at which a continuous web on which marking material is disposed is received; a third roll positioned to contact the web prior to entering the fixing nip; and an adjustment mechanism connected to the third roll, the adjustment mechanism being operable to move the third roll to vary a wrap length of the web contacting the outer surface of the first roll upstream from the fixing nip to control pre-heating of the web and marking material by contact with the outer surface prior to entering the fixing nip. The first roll and second roll are operable to apply heat and pressure to the pre-heated web and marking material at the fixing nip to fix the marking material to the web.

DRAWINGS

DETAILED DESCRIPTION

Figure 1:
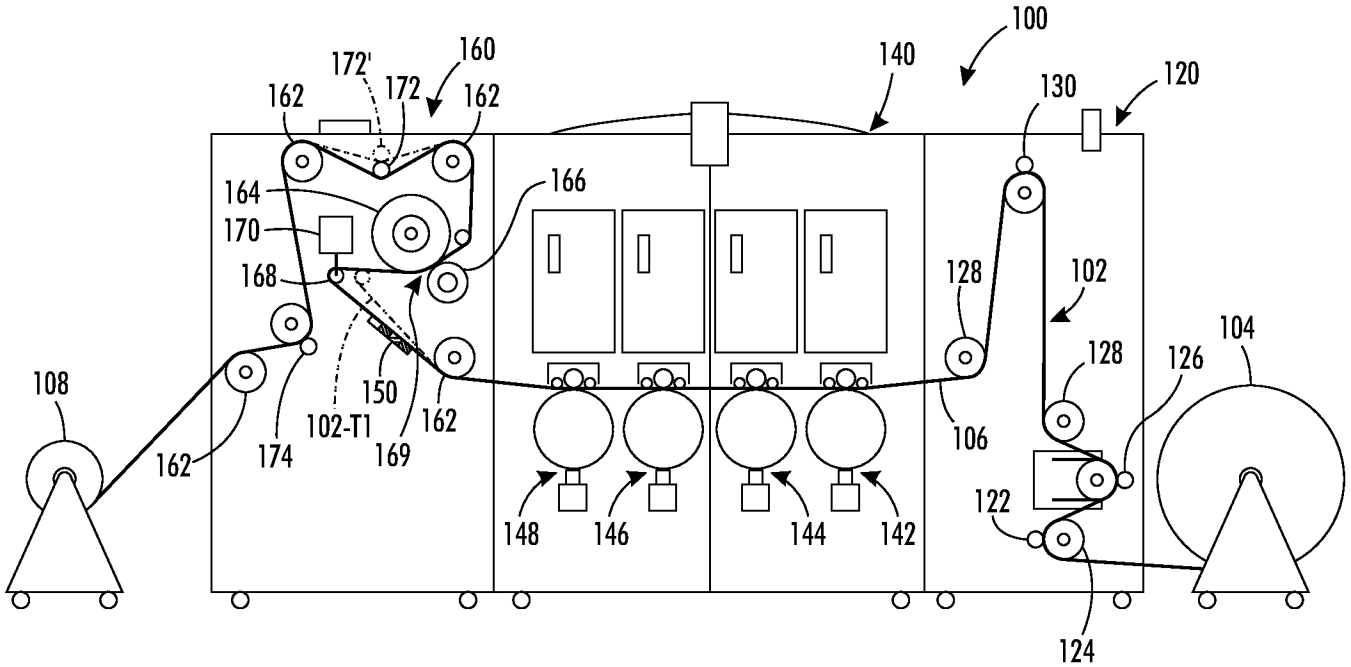
FIG. 1 depicts a printing apparatus including an exemplary embodiment of a fixing device that pre-heats a web and marking material.

The disclosed embodiments include fixing devices for fixing marking material to a web. An exemplary embodiment of the fixing devices comprises a first roll including a heated outer surface; a second roll forming a fixing nip with the outer surface of the first roll at which a continuous web on which marking material is disposed is received; a third roll positioned to contact the web prior to entering the fixing nip; and an adjustment mechanism connected to the third roll. The adjustment mechanism is operable to move the third roll to vary a wrap length of the web contacting the outer surface of the first roll upstream from the fixing nip to control pre-heating of the web and marking material by contact with the outer surface prior to entering the fixing nip. The first roll and second roll are operable to apply heat and pressure to the pre-heated web and marking material at the fixing nip to fix the marking material to the web.

The disclosed embodiments further include printing apparatuses. An exemplary embodiment of the printing apparatuses comprises a marking device for applying marking material to a continuous web; and a fixing device downstream from the marking device for fixing the marking material to the web. The fixing device comprises a first roll including a heated outer surface; a second roll forming a fixing nip with the outer surface of the first roll at which the web is received; a third roll positioned to contact the web prior to entering the fixing nip; and an adjustment mechanism connected to the third roll. The adjustment mechanism is operable to move the third roll to vary a wrap length of the web contacting the outer surface of the first roll upstream from the fixing nip to control pre-heating of the web and marking material by contact with the outer surface prior to entering the fixing nip. The first roll and second roll are operable to apply heat and pressure to the pre-heated web and marking material at the fixing nip to fix the marking material to the web.

The disclosed embodiments further include methods of fixing marking material to a web. An exemplary embodiment of the methods comprises applying a marking material to a continuous web; feeding the web to a fixing nip formed by a heated outer surface of a first roll and a second roll; positioning a third roll on which the web is entrained upstream from the fixing nip with an adjustment mechanism connected to the third roll, the adjustment mechanism moving the third roll to vary a wrap length of the web contacting the outer surface of the first roll upstream from the fixing nip to control pre-heating of the web and marking material by contact with the outer surface of the first roll prior to entering the fixing nip; and applying heat and pressure to the pre-heated web and marking material at the fixing nip with the first roll and second roll to fix the marking material to the pre-heated web.

Printing processes can utilize dry toner materials to form images on substrates, such as paper. In such printing processes, the toner images can be fixed to the substrates by applying thermal energy and pressure to the images at a fixing nip. Substrates can be heated prior to entering a fixing nip using a non-contact heating device including a radiant heating device, such as flash lamps and radiant heaters, or a convective heating device, such as a forced hot air device. It has been noted that flash heating systems may need frequent replacement and costly filtration systems, and radiant heating may cause defects for coated substrates and exposed lamps may pose fire risks. Convective heating systems may have the disadvantage of lower heat transfer efficiency to substrates.

In light of these and other considerations, fixing devices for fixing marking material to a web are provided. The fixing devices utilize contact pre-heating of the web and marking material prior to final fixing of the marking material to the web at a nip by the use of applied thermal energy and pressure. By increasing the marking material/substrate temperature by pre-heating prior to entering the fixing nip, the fixing nip can then be operated at lower process conditions including lower temperature, lower pressure and/or shorter dwell time.

FIG. 1 depicts an exemplary embodiment of a printing apparatus 100 for forming images on continuous webs. As used herein, the term "printing apparatus" can encompass various types of apparatuses that form images on substrates, such as printers, copy machines, facsimile machines, multifunction machines, and the like, or portions of such apparatuses. In embodiments, the printing apparatus 100 can be used in xerographic printing processes. The printing apparatus 100 includes a web feeding device 120, a marking device 140 and a fixing device 160. A roll of a web 102 is provided on a supply spool 104. The web 102 is fed from the supply spool 104 to the web feeding device 120, advanced to the marking device 140 to apply marking material to a surface 106 of the web 102, and then advanced to the fixing device 160 to fix the marking material to the surface 106. After advancing through the fixing device 160, the printed web 102 is collected on a collecting spool 108.

The web feeding device 120 comprises back tension rolls 122, 124, which produce controlled back tension in the web 102, i.e., braking action. Aligning rolls 126 (only one roll is shown) axially bias the web 102 to one side. A drive roll 130 is used to maintain a desired amount of tension in the web 102 and a desired speed of the web 102 through the printing apparatus 100. Idler rolls 128 support the web 102.

The illustrated marking device 140 includes marking stations 142, 144, 146 and 148 arranged in series along the process direction of the web 102. The marking stations 142, 144, 146 and 148 can, e.g., include a supply of a black, cyan, magenta and yellow marking material, respectively. The marking materials can be applied to the surface 104 of the web 102 to form a color image 150. The marking device 140 can also produce monochromatic images. The marking materials comprise toner, and can also comprise carriers and one or more additives to provide the desired properties to the marking material.

The fixing device 160 includes idler rolls 162 supporting the web 102. A fixing roll 164 and a pressure roll 166 form a fixing nip 169 through which the web 102 is advanced during printing. Typically, the fixing roll 164 is the drive roll. The fixing roll 164 and pressure roll 166 apply sufficient thermal energy and pressure to the web 102 at the nip to fix or fuse the image 150 to the web 102.

A pre-nip tension roll 168 is disposed directly upstream of the fixing roll 164 and pressure roll 166. The pre-nip tension roll 168 typically has a cylindrical configuration and can be a hard roll. An adjustment mechanism 170 is connected to the pre-nip tension roll 168. The adjustment mechanism 170 is operable to adjustably move the pre-nip tension roll 168 relative to the fixing nip 169. For example, the pre-nip tension roll 168 can be mounted to an arm, or the like, and the adjustment mechanism 170 can include a mechanism connected to the arm. The adjustment mechanism 170 can be connected to a controller (not shown) to control its operation.

The fixing device 160 further includes a post-nip tension roll 172. As shown, the post-nip tension roll 172 is adjustably movable to vary the amount of tension in the web 102 as depicted at 172'. A sub-drive roll 174 is further provided in the fixing device 160. The rotation speed of the sub-drive roll 174 is dependent on the position of the pre-nip tension roll 168.

Figure 2:
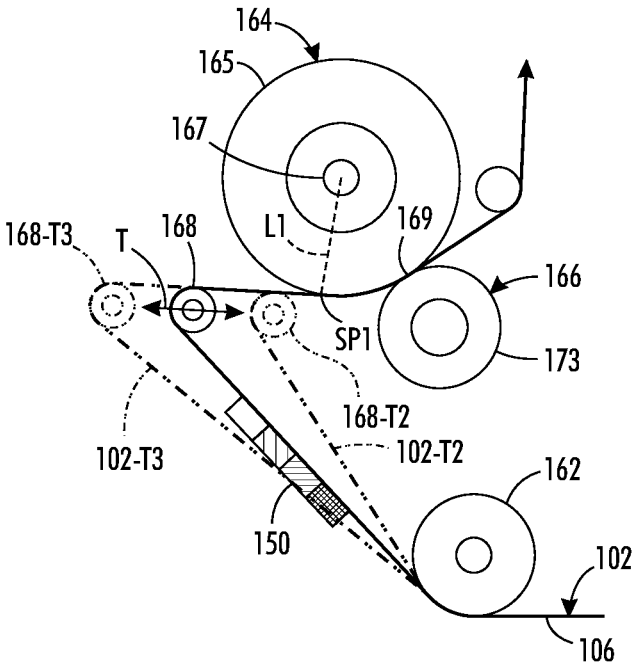
FIG. 2 depicts a portion of the fixing device shown in FIG. 1 illustrating the adjustment of tension in the web by movement of a pre-nip tension roll.
Figure 3:
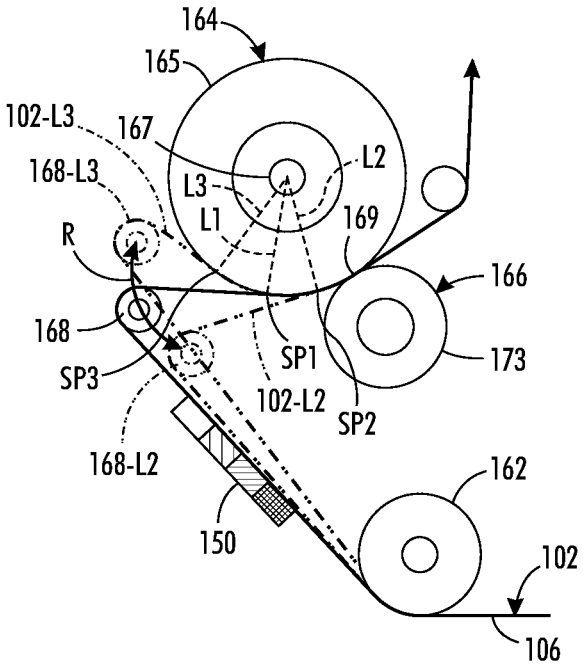
FIG. 3 depicts the portion of the fixing device shown in FIG. 2 illustrating the adjustment of the pre-nip contact angle of the web with the fixing roll by movement of the pre-nip tension roll.

FIGS. 2 and 3 illustrate an exemplary range of adjustability of the position of the pre-nip tension roll 168 utilizing the adjustment mechanism 170 (not shown). As shown in FIG. 2, the pre-nip tension roll 168 can be selectively translated either toward or away from the fixing nip 169 formed by the fixing roll 164 and pressure roll 166, as indicated by arrow T. The pre-nip tension roll 168 can be moved linearly relative to the fixing nip 169 in the opposite directions to vary the amount of tension in the web 102. When the pre-nip tension roll 168 is moved toward the fixing nip 169 to the position indicated at 168-T2, the web 102 is moved to a position indicated at 102-T2. This translational movement of the pre-nip tension roll 168 reduces the tension in the web 102, i.e., increases slack in the web 102. When the pre-nip tension roll 168 is moved away from the fixing nip 169 to the position indicated at 168-T3, the web 102 is moved to a position indicated at 102-T3. This translational movement of the pre-nip tension roll 168 increases the tension in the web 102, i.e., reduces slack in the web 102. The pre-nip tension roll 168 can typically be moved over a distance range of, e.g., about 50 mm to about 250 mm to adjust tension in the web 102.

By configuring the rolls in the fixing device 160 so that the roll immediately prior to the location of the web 102 wrap (i.e., the pre-nip tensioning roll 168) functions as the tensioning roll, space and the number of rolls effective to provide the desired fixing of marking material onto the continuous web 102 can be minimized in the fixing device 160.

As shown in FIG. 2, the web 102 contacts the outer surface 165 of the fixing roll 164 over a wrap length L1 in each of the three illustrated positions of the pre-nip tension roll 168. The wrap length L1 corresponds to the arc length about the outer surface 165 contacted by the web 102 starting from the inlet end of the fixing nip 169 and moving clockwise about the outer surface 165 to a separation point, SP1, at which the web 102 separates from the outer surface 165. The web 102 and marking material 150 are subjected to a lower pressure along the wrap length L1 as compared to the pressure applied by the fixing roll 164 and pressure roll 166 at the fixing nip 169. The wrap length of the web 102 on the fixing roll 164 can be set as a function of the type of web 102 used in the printing apparatus 100. For example, for a paper web 102, the wrap length can be set to different lengths based on the paper weight, which can range from light-weight to heavy-weight, on whether the paper is coated or uncoated, and for packaging materials and labels. The wrap length L1 of the web 102 remains substantially constant when the pre-nip tension roll 168 is moved to the position 168-T2 to decrease tension, or to the position 168-T3 to increase tension.

As shown in FIG. 3, the pre-nip tension roll 168 is rotatable by the adjustment mechanism (not shown) as indicated by arrow R to vary the wrap length of the web 102 in contact with the outer surface 165 of the fixing roll 164. The rotation of the pre-nip tension roll 168 can be along a substantially circular path, for example. As shown, the pre-nip tension roll 168 can be rotated counter-clockwise to the position indicated at 168-

L2 to decrease the wrap length of the web indicated at 102-L2 from L1 to L2, which moves the separation point of the web 102 counter-clockwise from SP1 to SP2. Alternatively, the pre-nip tension roll 168 can be rotated clockwise to the position indicated at 168-L3 to increase the wrap length of the web indicated at 102-L3 from L1 to L3, which moves the separation point of the web 102 clockwise from SP1 to SP3.

When the wrap length of the web 102 is set, the pre-nip tension roll 168 can be positioned to adjust tension in the web 102 to the desired level. Adjusting the tension in the web 102 by moving the pre-nip tension roll 168 substantially does not affect the total energy transfer from the fixing roll 164 to the web 102 and marking material 160 in either the low-pressure nip formed by the web 102 wrap or the relatively high-pressure fixing nip 169 formed by the fixing roll 164 and pressure roll 166.

The fixing roll 164 can be internally and/or externally heated. For example, the fixing roll 164 can include at least one internal heating element 167, such as at least one axially-extending lamp, to heat the outer surface 165 to the desired temperature. In embodiments, the outer surface 165 can be comprised of a relatively-hard material, such as a metallic or ceramic material. For example, the fixing roll 164 can comprise an aluminum core and the outer surface 165 can be comprised of anodized aluminum. Although the web 102 is simultaneously present in the low-pressure nip defined by the wrap length L1 of the web 102 and the higher pressure fixing nip 169 formed by the fixing roll 164 and the pressure roll 166, the hard outer surface 165 is effective to minimize relative motion of the web 102 between these two nips and substantially eliminate stresses between these nips. Consequently, web defects including stretching, wrinkle and/or image smearing caused by relative motion of a web present in two nips can be minimized. In addition, stripping of the web 102 from the outer surface 165 is enhanced by the web 102 being actively pulled from the exit end of the fixing nip 169 by tension in the web 102.

The pressure roll 166 can comprise, e.g., a non-deformable core and at least one layer of a deformable polymeric material overlying the core and forming the outer surface 173. For example, the deformable material can be an elastomeric material, such as silicone rubber, or the like. In other embodiments, the pressure roll 166 can comprise a harder, less deformable polymeric material, such as polyurethane, or the like, overlying the core. The harder polymeric material can have a total thickness of about 1 mm to about 7 mm, for example. The harder polymeric material can be applied as a single layer, or as two or more layers. Different layers of multi-layer constructions can have a different composition and properties from each other, e.g., a different elastic modulus.

In the printing apparatus 100 with continuous feeding of the web 102, the type of web 102 that is run normally is not changed abruptly during printing. It is desirable to run the fixing roll 164 at about the same speed for different types of the web 102 that can be used in the printing apparatus 100. High printing speeds can be used in the printing apparatus 100 for all types of the web 102. The wrap length of the web 102 on the fixing roll 164 can be adjusted for each different type of the web 102 by positioning the pre-nip tension roll 168 at a selected position that provides a selected wrap length of the web 102. For example, for a heavy-weight web 102, the wrap length can be increased to the wrap length L3 (FIG. 3) and the pre-nip tension roll 168 can be positioned to provide the desired tension in the web 102. For a light-weight web 102, the wrap length can be decreased to the wrap length L2 (FIG. 3) and the pre-nip tension roll 168 can be positioned to provide the desired tension in the web 102.

Increasing the wrap length of the web 102 on the fixing roll 164 increases the amount of time (dwell) that the web 102 contacts the outer surface 165 of the fixing roll 164 before advancing to the fixing nip 169. Increasing the dwell increases the amount of thermal energy conducted from the heated outer surface 165 of the fixing roll 164 to the web 102 and marking material 150 before the web 102 advances to the fixing nip 169. Pre-heating the web 102 and marking material prior to entering the fixing nip 169 allows the fixing nip 169 to be operated at a lower temperature, pressure and/or dwell time (i.e., higher process speed), as compared to not using pre-heating. Some amount of fixing or fusing of the marking material 150 to the web 102 may occur during pre-heating, depending on the temperature reached. Final fixing or permanence of the marking material is achieved after the web 102 passes through the fixing nip 169.

In embodiments, the wrap length of the web 102 on the outer surface 165 of the fixing roll 164 can be varied to control image gloss by controlling the temperature reached by the marking material. Generally, increasing the wrap length increases gloss.

The web 102 may or may not be actively heated before it is advanced to the fixing roll 164. When the web 102 is not actively heated in such manner, the web 102 and marking material 150 are typically at about the ambient cavity temperature of the printing apparatus 100 when arriving at the fixing roll 164. The outer surface 165 of the fixing roll 164 typically can be heated to a temperature of about 50° C. to about 200° C. for fixing marking material on different types of the web 102. The pressure applied at the fixing nip 169 can typically be from about 50 psi to about 750 psi. At these temperatures of the outer surface 165, the temperature to which the web 102 and marking material 150 are pre-heated by contact with the outer surface 165 can be kept below about 125° C., such as less than about 100° C., i.e., the boiling point of water at standard conditions, by controlling the temperature of the fixing roll 164 and the wrap length of the web 102. When the marking material 150 is not heated to above 100° C., problems caused by the vaporization of water contained in print media, which include damage to the media (blistering) and/or damage to the images (e.g., blow-off or icicles), can be avoided in the fixing device 160.

Figure 4A:
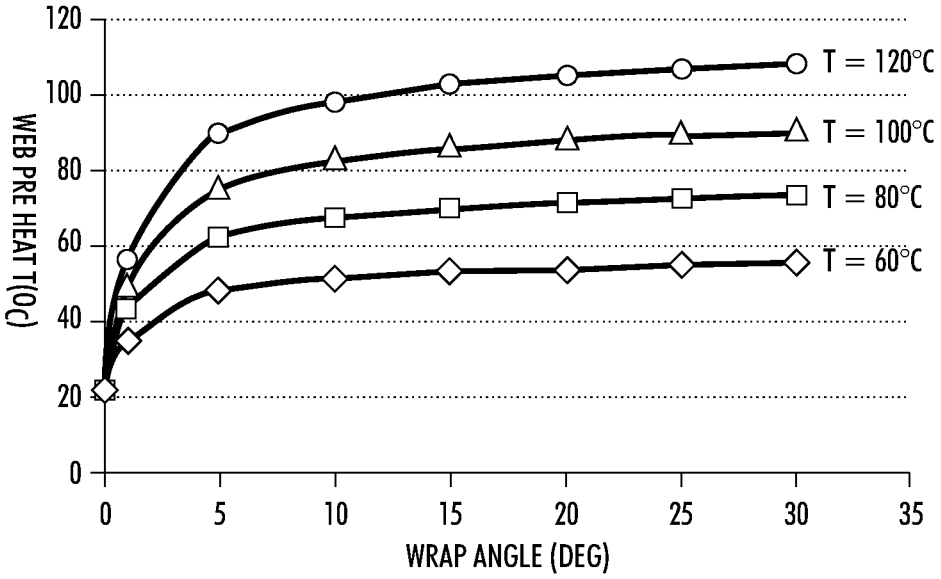
FIG. 4A illustrates a modeled plot showing the pre-heat temperature of a web as a function of the wrap angle of the web on a fixing roll for different fixing roll temperatures.
Figure 4B:
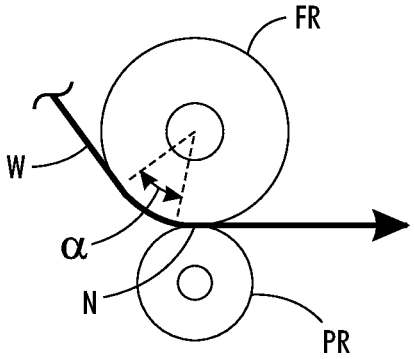
FIG. 4B depicts a fixing device configuration used in the modeling depicted in FIG. 4A.

FIG. 4A illustrates a plot showing the modeled pre-heated temperature of a web as a function of wrap angle of the web on a heated fixing roll for outer surface temperatures of 60° C., 80° C., 100° C. and 120° C. of the fixing roll. FIG. 4B shows the fixing device configuration used in the modeling, which includes a fixing roll, FR, and a pressure roll, PR, forming a nip, N. A web contacts the fixing roll FR over a wrap angle, $\alpha$. As shown, the wrap angle $\alpha$ is the angle of the arc over which the web W contacts the outer surface of the fixing roll FR starting from an inlet end of the nip N and moving clockwise along the outer surface to the separation point of the web W from the outer surface. In the model, the following values were used: fixing roll diameter: 162 mm; fixing roll speed: 1 m/s; resistance of transferring heat between surfaces: 0.0001 $m^2K/W$; pressure roll temperature: 50° C.; and web type: uncoated, 90 gsm paper.

As shown in FIG. 4A, for a given fixing roll temperature, increasing the wrap angle of the web increases the pre-heat temperature of the web. Increasing the wrap angle allows a lower fixing roll temperature to be used to achieve the desired web pre-heat temperature. For example, a web pre-heat temperature of 80° C. can be achieved using a fixing roll temperature of 100° C. and a wrap angle of about 6° instead of using a higher fixing roll temperature of 120° C. and a smaller wrap angle of about 3°.

As shown in FIG. 4A, for a given fixing roll, pressure roll, web type and marking material, plots showing the web pre-heat temperature versus the wrap angle (or wrap length) for different fixing roll temperatures can be generated either by modeling or experimentally, to allow pre-determined or controlled positioning of the pre-nip tension roll to provide the desired wrap length.

In the fixing device 160, the use of contact pre-heating of the web 102 combined with use of a relatively lower temperature/higher pressure applied at the fixing nip 169 can facilitate the use of low-melting and ultra-low-melting toner materials characterized as having a melting temperature that is altered (lowered) by heating the toner to a temperature above a threshold temperature and then re-heating the toner having a lowered melting temperature. Exemplary ultra-low-melting toners having these characteristics comprise a crystalline polymer material, such as crystalline polyester material, and an amorphous polymer material, such as amorphous polyester material, with the amorphous material having a glass transition temperature ($T_g$) separate from the melting temperature ($T_m$) of the crystalline material. In these toners, the crystalline polymer material imparts a low melting temperature to the toner. Heating of the toner causes the crystalline material to plasticize the amorphous material, suppresses $T_g$ of the amorphous material, and essentially eliminates $T_m$ of the crystalline material. Exemplary toners having alterable melting temperature characteristics that may be used in the fixing device are disclosed in U.S. Pat. Nos. 7,402,371; 7,494,757 and 7,547,499, each of which is incorporated herein by reference in its entirety.

Toners having such temperature-alterable melting characteristics can be used in the fixing device 160 to further enhance the effectiveness of the conductive pre-heating of the web 102 and marking material in the fixing process. These toners can undergo a reduction in their melting temperature prior to fixing of the toner at the fixing nip 169. The amorphous polymer material can be plasticized by heating the toner to a temperature above a threshold temperature by pre-heating the web 102 and marking material at the web contact zone with the fixing roll 164, which lowers the melting temperature of the toner. As the web 102 is advanced to the fixing nip 169, additional thermal energy is applied to the web 102 and toner with the heated fixing roll 164. By lowering the toner melting temperature by this pre-heating, the process conditions of temperature, pressure and/or dwell can be lowered in the fixing nip 169.

It will be appreciated that various ones of the above-disclosed, as well as other features and functions, or alternatives thereof, may be desirably combined into many other different systems or applications. Also, various presently unforeseen or unanticipated alternatives, modifications, variations or improvements therein may be subsequently made by those skilled in the art, which are also intended to be encompassed by the following claims.

What is claimed is:

1. A fixing device for fixing marking material to a web, comprising:

a first roll including a heated outer surface;

a second roll forming a fixing nip with the heated outer surface of the first roll at which a continuous web on which marking material is received;

a third roll positioned to contact the web prior to entering the fixing nip; and an adjustment mechanism connected to the third roll, the adjustment mechanism being operable to move the third roll to vary a wrap length of the web contacting the heated outer surface of the first roll upstream from the fixing nip to control pre-heating of the web and pre-heating of the marking material by contact with the heated outer surface prior to entering the fixing nip;

wherein the first roll and second roll are operable to apply heat and pressure to the pre-heated web and marking material by contacting the pre-heated marking material at the fixing nip to fix the marking material to the pre-heated web.

2. The fixing device of claim 1, wherein the first roll comprises at least one internal heating element for causing the heated outer surface.

3. The fixing device of claim 1, wherein the first outer surface comprises anodized aluminum.

4. The fixing device of claim 1, wherein the second roll comprises an outer surface comprising a polymer.

5. The fixing device of claim 1, wherein the adjustment mechanism is operable to rotate the third roll in a substantially circular path (i) in a first direction to increase the wrap length of the web in contact with the outer surface of the first roll to increase the pre-heating of the web and marking material, or (ii) in a second direction opposite to the first direction to decrease the wrap length to decrease the pre-heating of the web and marking material.

6. The fixing device of claim 5, wherein the adjustment mechanism is further operable to translate the third roll along a substantially linear path, with the web being maintained to have a substantially fixed separation point from the heated outer surface of the first roll upstream from the fixing nip, (iii) toward the fixing nip to decrease an amount of tension in the web or (iv) away from the fixing nip to increase an amount of tension in the web;

wherein the first roll comprises at least one internal heating element for causing the heated outer surface;

wherein the first roll comprises an anodized aluminum outer surface;

wherein the second roll comprises an outer surface comprising a polymer.

7. A printing apparatus, comprising:

a marking device for applying marking material to a continuous web; and a fixing device downstream from the marking device for fixing the marking material to the web, the fixing device comprising:

a first roll including a heated outer surface;

a second roll forming a fixing nip with the outer surface of the first roll at which the web is received;

a third roll positioned to contact the web prior to entering the fixing nip; and an adjustment mechanism connected to the third roll, the adjustment mechanism being operable to move the third roll to vary a wrap length of the web contacting the outer surface of the first roll upstream from the fixing nip to control pre-heating of the web and marking material, the marking material being disposed on the web during the pre-heating, by contact with the heated outer surface prior to entering the fixing nip;

wherein the first roll and second roll are operable to apply heat and pressure to the pre-heated web and the pre-heated marking material at the fixing nip to fix the marking material to the web.

8. The printing apparatus of claim 7, wherein the first roll comprises at least one internal heating element for causing the heated outer surface.

9. The printing apparatus of claim 7, wherein:

the first roll comprises an anodized aluminum outer surface; and the second roll comprises an outer surface which is comprised of a polymer.

10. The printing apparatus of claim 7, wherein the adjustment mechanism is operable to rotate the third roll along a substantially circular path (i) in a first direction to increase the wrap length of the web in contact with the heated outer surface of the first roll to increase the pre-heating of the web and marking material, or (ii) in a second direction opposite to the first direction to decrease the wrap length to decrease the pre-heating of the web and marking material.

11. The printing apparatus of claim 10, wherein the adjustment mechanism is further operable to translate the third roll along a substantially linear path, with the web being maintained to have a substantially fixed separation point from the outer surface of the first roll upstream from the fixing nip, (iii) toward the fixing nip to decrease an amount of tension in the web or (iv) away from the fixing nip to increase an amount of tension in the web.

12. The printing apparatus of claim 7, wherein the marking material comprises toner.

13. The printing apparatus of claim 12, wherein:

the toner comprises a crystalline polymer material and an amorphous polymer material, the toner having a melting temperature which is lowered by heating the toner to a temperature above a threshold temperature; and the marking device comprises at least one marking station, each marking station containing a supply of the marking material for applying to the continuous web.

14. A method of fixing marking material to a web, comprising:

applying a marking material to a continuous web;

feeding the web to a fixing nip formed by a heated outer surface of a first roll and a second roll;

positioning a third roll on which the web is entrained upstream from the fixing nip with an adjustment mechanism connected to the third roll;

moving with the adjustment mechanism the third roll to vary a wrap length of the web contacting the heated outer surface of the first roll upstream from the fixing nip to control pre-heating of the web and marking material by contact with the heated outer surface of the first roll prior to entering the fixing nip; and applying heat and pressure to the pre-heated web and the pre-heated marking material at the fixing nip with the first roll and second roll to fix the pre-heated marking material to the pre-heated web, the marking material being pre-heated while disposed on the web before the web enters the fixing nip.

15. The method of claim 14, wherein the marking material comprises toner.

16. The method of claim 15, wherein the toner comprises a crystalline polymer material and an amorphous polymer material, the toner having a melting temperature which is lowered by heating the toner to a temperature above a threshold temperature during the pre-heating of the web.

17. The method of claim 14, wherein the web is pre-heated to a temperature of less than about 125° C.

18. The method of claim 17, wherein the web is pre-heated to a temperature of less than about 100° C.

19. The method of claim 14, wherein the adjustment mechanism rotates the third roll along a substantially circular path (i) in a first direction to increase the wrap length of the web in contact with the outer surface of the first roll to increase the pre-heating of the web and marking material, or (ii) in a second direction opposite to the first direction to decrease the wrap length to decrease the pre-heating of the web and marking material.

20. The method of claim 19, wherein the adjustment mechanism additionally translates the third roll along a substantially linear path, with the web being maintained to have a substantially fixed separation point from the outer surface of the first roll upstream from the fixing nip, (iii) toward the fixing nip to decrease an amount of tension in the web or (iv) away from the fixing nip to increase an amount of tension in the web.

21. The method of claim 14, wherein the web and marking material are pre-heated to a selected temperature by contact with the outer surface of the first roll prior to entering the fixing nip to control gloss of the marking material on the web.

22. The method of claim 14, wherein the web and marking material are pre-heated to a selected temperature by contact with the outer surface of the first roll prior to entering the fixing nip based on the type of the web.

* * * * *